United States Patent [19]

Alexander et al.

[11] Patent Number: 4,818,628

[45] Date of Patent: Apr. 4, 1989

[54] PROCESS FOR MAKING COMPOSITE BEARING MATERIAL PRODUCED THEREBY

[75] Inventors: Robert G. Alexander; George C. Pratt, both of Ann Arbor, Mich.

[73] Assignee: Federal-Mogul Corporation, Southfield, Mich.

[21] Appl. No.: 91,339

[22] Filed: Aug. 31, 1987

Related U.S. Application Data

[63] Continuation of Ser. No. 15,591, Feb. 17, 1987, abandoned, which is a continuation of Ser. No. 868,236, May 28, 1986, abandoned.

[51] Int. Cl.[4] ..... B22F 7/04

[52] U.S. Cl. ..... 428/561; 384/912; 252/12; 420/474; 428/553; 428/677; 419/8; 419/9; 419/23; 419/28; 419/29; 419/55; 419/57; 148/13.2; 148/126.1; 148/127; 148/433

[58] Field of Search ..... 148/13.2, 126.1, 127, 148/433; 252/12; 384/912; 420/479; 419/8, 9, 23, 28, 29, 55, 57; 428/553, 677, 561

[56] References Cited

U.S. PATENT DOCUMENTS

| | | | |
|---|---|---|---|
| 2,040,053 | 5/1936 | Lytle | 420/474 |
| 2,280,103 | 4/1942 | Swartz et al. | 420/474 |
| 2,635,020 | 4/1953 | Beebe, Jr. | 308/237 |
| 2,970,933 | 2/1961 | Barera et al. | 117/71 |
| 2,986,464 | 5/1961 | Lewis et al. | 75/208 |
| 3,154,844 | 11/1964 | Sayre et al. | 29/420 |
| 3,445,909 | 5/1969 | Beebe, Jr. | 29/149.5 |
| 3,730,705 | 5/1973 | Latrobe | 420/474 |
| 4,002,472 | 1/1977 | LeBrasse et al. | 75/208 R |
| 4,206,268 | 6/1980 | Roemer et al. | 420/474 |
| 4,406,857 | 9/1983 | Mahrus et al. | 419/7 |

*Primary Examiner*—Stephen J. Lechert, Jr.

*Attorney, Agent, or Firm*—Robert F. Hess; Lawrence J. Shurupoff

[57] ABSTRACT

A process for making a composite bearing material comprising a steel backed, prealloyed, lead-bronze sintered powder metal matrix whereby the first sinter step includes induction heating the prealloyed powder and steel backing to above 650° C. and thereafter sintering the same at temperatures of about 850° C. in a second sintering furnace. A composite bearing material made by the same process and comprising a lead particle size averaging less than about 8 microns and having no lead islands larger than about 44 microns.

6 Claims, No Drawings

PROCESS FOR MAKING COMPOSITE BEARING MATERIAL PRODUCED THEREBY

This application is a continuation of application Ser. No. 015,591, filed Feb. 17, 1987, now abandoned, which is a continuation of Ser. No. 868,236, filed May 28, 1986, now abandoned.

CROSS-REFERENCE TO RELATED APPLICATION

The present application is closely related in subject matter pertaining to the bearing material to co-pending application Ser. No. 829,471 filed Feb. 13, 1986 now abandoned assigned to the same assignee as the present application.

BACKGROUND OF THE INVENTION

The present invention broadly relates to composite bearing materials which are comprised of a hard metal backing strip, such as steel, having a bearing lining composed of leaded bronze tenaciously bonded to at least one face surface thereof. Such composite bearing materials are eminently suitable and in widespread use for the fabrication of various bearing components for use in internal combustion engines, vehicle suspensions, transmission assemblies or the like.

Composite bearing materials of the foregoing general type have been produced by processes such as disclosed in U.S. Pat. No. 2,986,464 granted May 30, 1961 to Lewis et al and U.S. Pat. No. 4,002,472 granted Jan. 11, 1977 to LeBrasse et al which are also assigned to the assignee of the present invention. The teachings of the two aforementioned U.S. patents, to the extent that they are relevant to the present invention, are incorporated herein by reference.

While the processes disclosed and the resultant composite bearing material produced in accordance with the processes described in the aforementioned U.S. patents are eminently suitable for producing high quality composite bearing materials for the fabrication of various bearing components, less than optimum physical properties of the bearing lining and performance of the bearing components produced therefrom have been obtained due to the presence of relatively large-sized lead particles in the bearing lining. This is particularly true where, because of engine operating conditions (e.g. high dynamic loads, acidic engine oils and increased oil temperatures) a electrodeposited lead tin or lead tin copper overplate of the bearing material is required or desirable. This is because of the well known diffusion phenomena as described more fully in SAE Technical Paper 860355, authored by one of the coinventors of the present invention, the teachings of which are incorporated herein by reference to the extent relevant to an understanding of the present invention. At engine temperatures random diffusion of the tin atoms in the lead tin or lead tin copper overplate results in the formation of a layer of nickel tin intermetallic compound on top of the nickel barrier. The function of the nickel barrier is to prevent diffusion of the tin into the underlying copper lead. In the absence of a nickel barrier extensive tin diffusion takes place via the continuous lead phase, copper tin compound forms at the copper-lead interface and the loss of tin is much more serious. The tin content necessary to provide resistance to corrosion by acidic engine oils is around 3 percent. If there is no nickel barrier the tin content will fall to this value more quickly than when a nickel barrier is present, and the loss of tin is restricted to the formation of nickel tin compound only.

Under the high dynamic loads applied, particularly to the connecting rod bearings of the heavy duty diesel engine, breaks in the nickel barrier can occur. The breaks are found above the lead phase and result in a path being made available for diffusion of the tin atoms through the nickel barrier into the copper lead. Because the tin atoms are trapped in the copper lead as the copper tin compound, lead is forced out of the copper lead, carrying the broken nickel barrier with it. The breaks widen, permitting more tin diffusion and the broken section of the nickel barrier may end up half way through the thickness of the overplate. The likelihood of a nickel barrier break occurring is a function of the size of the lead phase underneath it. The coarser the lead the less the support for the barrier and the more likely a break is to occur.

Briefly stated, for this reason, attention has been given to factors affecting the lead size in sintered copper lead alloys, and process changes have been introduced which restrict growth of the lead during sintering and minimize the nickel barrier breakage during engine service. The present invention provides for an improved process and an improved composite bearing material produced thereby employing powder metallurgical techniques whereby a satisfactory tenacious bond is obtained between the bearing lining and the steel backing strip employing sintering conditions including time and temperature which inhibit the formation of large-sized lead particles thereby achieving a unique leaded-bronze lining characterized by an extremely fine-sized lead distribution dispersed uniformly throughout the bearing lining matrix.

SUMMARY OF THE INVENTION

The benefits and advantages of the present invention are achieved in accordance with the process aspects thereof, by applying to a steel backing strip a prealloyed leaded-bronze powder of an average particle size generally less than about 147 microns. Thereafter this superimposed powder layer is induction heated to a temperature of over 700° C., preferably 730° C. at which the steel backing ceases to be ferromagnetic. This is followed by immediately and continuously heating the partially sintered powder and strip to a temperature of from about 1450° F. (800° C.) to about 1600° F. (850° C.), typically about 1500° F. (825° C.) in a conventional sintering furnace for a period of time sufficient to effect a liquid phase sintering of the powder particles together and a bonding of the powder layer to the face of the strip. The sintered strip thereafter is cooled and is subjected to compaction such as by roll compaction in a manner to effect a substantially complete densification of the metal powder layer. Then the compacted composite strip is reheated to a temperature of about 1450° to 1600° F. for an additional period of time to further enhance the physical properties of the lining and to further enhance the bond between the lining and the backing strip. Thereafter, the resintered composite strip is cooled to a temperature below about 800° F., typically 300° F. to 450° F., in a protective atmosphere and, preferably, is again subjected to a warm compaction, typically at a temperature of about 300° F. to about 450° F. such as by roll compaction to further enhance the properties of the composite strip and to improve the sizing characteristics thereof.

The resultant composite strip can subsequently be employed for fabrication of various bearing components and the outer face of the lining can be machined to final dimensions. It is further contemplated that the machined outer face of the bearing lining can be subjected to an overplate of a suitable bearing metal or metal alloy such as a lead-tin or lead-tin-copper bearing alloy containing up to about 90 percent by weight lead.

In accordance with the product aspects of the present invention, the bearing lining of the composite bearing material is characterized as having a bearing lining nominally containing about 8 percent to about 35 percent by weight lead, about 0.5 to 10 percent by weight tin with the balance consisting essentially of copper. The bearing lining matrix is further characterized by the fact that the lead constituent thereof is substantially uniformly distributed throughout the lining matrix in the form of fine-sized particles of an average particle size typically less than about 8 microns and there being no lead islands larger than about 44 microns.

Additional benefits and advantages of the present invention will become apparent upon a reading of the Description of the Preferred Embodiments taken in conjunction with the specific examples provided.

DESCRIPTION OF THE PREFERRED EMBODIMENTS

The composite bearing material in accordance with a preferred practice of the present invention is basically comprised of a steel backing and metal powder lining sintered thereon. The steel backing is typically a low-alloy steel such as SAE Type 1010 or 1020 generally having a thickness of from about 0.040 inch up to about 0.250 inch, typically 0.125 inch for most automotive engine connecting rod bearings.

The metal powder employed in forming the bearing lining by powder metallurgical techniques comprises a copper-lead-tin prealloyed powder which may generally contain from about 8 percent to about 35 percent lead, up to 10 percent tin with the balance consisting essentially of copper. The use of the powder in a prealloyed form is important to achieve the unique distribution of the lead constituent in the final bearing lining. While it is preferred to employ prealloyed powders wherein each particle thereof is of the same composition as that of the final bearing lining desired, it is contemplated that prealloyed powders of alternative compositions can be mixed together to provide a resultant mixture corresponding to that of the final bearing lining. Typical of leaded-bronze alloys that can be satisfactorily employed in the practice of the present invention are SAE Grade 799, nominally containing 73.5 percent copper, 23 percent lead and 3.5 percent tin; SAE Grade 49, nominally containing 75.5 percent copper, 24 percent lead and 0.5 percent tin; SAE Grade 480, nominally composed of 64.5 percent copper, 35 percent lead and 0.5 percent tin. Particularly satisfactory results have been obtained for heavy-duty bearing linings produced in accordance with the practice of the present invention employing prealloyed powders containing about 80.5 percent to about 83.5 percent copper, about 13 to about 16 percent lead and about 3.5 percent tin. All alloy percentages stated herein are by weight.

The metallurgical structure of the copper lead lining comprises two distinct phases, namely an interconnected network of lead islands and a copper-rich matrix, the tin being in solution in the copper.

The shape of the prealloyed powder particles is not critical although particles of a generally spherical configuration are preferred. The particle size of the prealloyed powder should be less than about 100 mesh (147 microns) with particle sizes ranging to as small as about 1 micron. In accordance with a preferred practice, the prealloyed metal powder contains particles distributed over the permissible size range with 50 percent thereof being less than 325 mesh (44 microns) whereby optimum loose powder packing density is achieved. The loose powder density as applied to the metal plated backing strip generally ranges from about 50 percent to about 60 percent of 100 percent theoretical density. The quantity of powder applied will vary depending upon the specific type of bearing component to be fabricated from the composite bearing material and generally will range from about 0.020 inch to about 0.070 inch whereby upon subsequent sintering and compaction, the final lining will range in thickness from about 0.010 inch to about 0.050 inch.

The steel backing strip which is usually supplied in the form of a coil is subjected to appropriate cleaning such as vapor degreasing, alkaline, or acidic cleaning, wire brushing, and pickling as may be required to remove surfaces and soils and any rust and/or scale on the face surfaces thereof. The cleaned steel backing strip is thereafter advanced in a substantially horizontal position beneath a suitable feed hopper containing the prealloyed leaded-bronze powder which is applied in the form of a substantially uniform layer as controlled by a doctor knife or the like. The strip with the superimposed powder layer thereon thereafter sintered in a series of two furnaces, each of which is provided with a nonoxidizing atmosphere. For example, the nonoxidizing atmosphere preferably comprises a reducing atmosphere derived from the incomplete combustion of natural gas nominally containing about 12 percent hydrogen, 10 percent carbon monoxide and 5 percent carbon dioxide with the balance consisting essentially of nitrogen. The use of a reducing atmosphere provides the further advantage of reducing any oxides present on the surfaces of the powder particles and to prevent any further oxidation thereof at the elevated sintering temperatures encountered in the sintering furnace.

The first furnace is primarily a single induction coil. Induction sintering enables a bond to be established without a long duration heat-up time above 650° C., the temperature at which the lead particles begin to grow. In induction sintering electric currents are induced in the steel backing which heat the steel backing directly and the copper-lead powder by conduction and radiation from the steel. The currents may flow in the plane of the steel strip, or around the periphery of the strip or a combination of both depending on the geometry of the induction coil. It is possible that some heat is also produced directly in the powder layer.

Because the heat is induced in the strip itself, heat up rates are much faster than in conventional sintering, conventional sintering meaning an electric fired sintering furnace as described hereafter and as shown in aforementioned U.S. Pat. Nos. 2,986,464 and 4,002,472.

Induction heating of steel is particularly efficient up to about 730° C., the temperature at which steel ceases to be ferromagnetic. Thus, the preferred two furnace sintering process combines induction heating to 730° C. with conventional sintering from 730° C. to 800/850° C. Such a "hybrid" system offers useful savings in the cost of equipment and in running costs. It has been determined that the fast heat-up rates obtained in the induction part of the hybrid process permit metallurgical structures to be obtained which show little or no loss of the fine lead benefits obtained from a system which consists of induction sintering alone.

The second furnace is heated to a temperature ranging from about 1450° up to about 1600° F. The specific temperature employed in the second sintering furnace will vary somewhat depending upon the particular composition of the prealloyed powder and is adjusted to produce sufficient liquid phase comprised predominantly of lead which effects a wetting of the powder particles and a filling of the interstices present in the powder layer in addition to a wetting of the surface of the steel strip to promote the formation of a tenacious bond. Generally, sintering temperatures below about 1450° F. are unsatisfactory due to the failure to form an appreciable bond between the powder layer and the backing strip whereas temperatures in excess of about 1600° F. are also unsatisfactory due to the formation of an excessive amount of liquid phase.

Under conventional practice employing a single conventional sintering furnace, the sintering temperature is controlled at about 1500° F. for a period of about 3 to about 5 minutes at the sintering temperature. In accordance with the present invention, in light of the first induction heating, the time at sintering temperature in the second furnace of the first sinter may be reduced to no more than about 2 minutes and preferably less. Ideally, the total time at sintering temperature in both furnaces will be about 2 minutes. Since lead growth is directly dependent upon the time the alloy is held at or near sintering temperature, the lead size of the alloy as produced by the present invention is significantly finer than that produced by conventional sintering techniques.

Alternatively, the second sintering furnace of the first sinter can be eliminated and the entire sintering step effected in the induction coil. However, as mentioned above, induction heating steel beyond 730° C. is not efficient. Even so, the total time spent by the composite bearing strip above 650° C. would be significantly decreased and preferably just under 1 minute. Lead growth will therefore be at a minimum, and quite probably less than that shown in Table 1 below.

At the conclusion of the sintering operation, the composite strip exits from the sintering furnace and enters a suitable cooling section provided with a nonoxidizing protective atmosphere in which it is cooled to a temperature below about 300° F. whereafter the strip is compacted to substantially 100 percent of theoretical density to reduce any residual voids in the powder layer. The compaction can conveniently be achieved by passing the strip through a pair of compaction rolls.

Following the roll compaction step, the composite strip is again reheated in a furnace provided with a nonoxidizing, preferably, reducing atmosphere to a temperature within the same range as the first sintering temperature and preferably about 1500° F. for a total residence period of about 10 minutes including a preheating period to provide a sintering time at temperature of about 3 to about 5 minutes to effect a further enhancement of the bond between the bearing lining and the steel backing strip and a further improvement in the physical characteristics of the bearing lining. Following the reheating operation, the steel strip is cooled in a protective atmosphere, preferably by passing the strip through a molten lead bath at a temperature of about 800° F. which effects a further filling of any residual pores present in the bearing lining. Upon further cooling, preferably to a temperature within the range of about 300° to 450° F., the cooled composite strip is subjected to a further final compaction, preferably a warm roll compaction step to provide for still further improvements in the properties of the composite strip and to effect a sizing and improved uniformity of the bearing lining thereon.

The resultant composite strip can thereafter readily be coiled and transferred to further fabricating operations to fabricate bearing components such as shell-type bearings, bushings, thrustwashers, and the like.

Following the bearing component fabrication step, the face of the bearing lining is usually subjected to a further final finishing operation to provide a precision bearing component. Optionally, and preferably, the machined bearing surface can be provided with an overplate of a suitable soft metal bearing lining of any of the types well known in the art. In accordance with a preferred practice of the present invention, the machined bearing face is electroplated to provide a nickel barrier layer on the lining surface of a thickness typically between 0.0001 and 0.005 mm (0.00004 and 0.0002 inches). Wherafter a suitable overplate is applied at a thickness of about 0.01 mm to about 0.05 mm (0.0004 to about 0.002 inch). With the copper-lead alloys mentioned previously, a preferred overlay composition is PbSn10Cu2, and a overlay thickness is about 0.025 mm. Generally suitable is any bearing alloy containing about 2 to about 4 percent copper, about 8 to about 12 percent tin, and the balance consisting essentially of lead.

In accordance with the process as hereinbefore described, the bearing lining is characterized by the lead constituent thereof being present in the form of extremely fine-sized particles substantially uniformly distributed throughout the lining matrix from the bearing face inwardly to the backing strip. The lead particles are further characterized as being of an average particle size typically less than about 8 microns (distributed at a particle count of at least about 1550 particles per square millimeter) and there being no lead particles larger than 44 microns and less than about 0.4 percent of the lead particles being larger than 36 microns. The extremely fine size of the lead particles and their substantially uniform distribution throughout the lining matrix renders such linings eminently suitable for heavy duty-type bearing applications due to the improved physical properties of such bearing linings in comparison to conventional prior art bearing linings of similar alloy composition in which the lead particles are of substantially greater size and/or of nonuniform distribution. The fine-sized particles are achieved primarily in accordance with the specific conditions employed in the induction sintering process which substantially inhibits an agglomeration of the lead constituent into undesirable larger particles in accordance with prior art practices.

In order to fully illustrate the process of the present invention, the following specific example is provided.

EXAMPLE

SAE type 1010 steel in coil form 0.075 inch thick was cleaned by conventional procedures. A prealloyed, minus 100 mesh, leaded-bronze powder containing about 14 percent by weight lead, about 3.5 percent tin and the balance copper was applied to one face of the steel coil to a thickness of about 0.047 inch. The powder layer and coil strip was passed through an induction solonoid coil fed from a 650 KHZ generator and the electric current induced in the steel so as to flow around the periphery of the strip. The strip was heated to about 730° C. and, upon reaching such temperature, was cooled down and a test strip measuring 6 inches by 2 inches was taken from the coil strip and transferred to a conventional electric fired sintering furnace, as described herein, and heated to a temperature in excess of 650° C. for a period of about 5.1 minutes. The effective total residence time in both furnaces was about 5.2 minutes, and total time at sintering temperature of about 800° C. was about 2 minutes. Thereafter, the strip was cooled to room temperature (70° F.) and densified by passing through a roll compactor to compact the powder layer to about 0.023 inch. The compacted composite test strip was reheated in a conventional sintering furnace to a temperature of about 1490° F. for an additional period of about 10 minutes including a preheating to temperature and final sinter at temperature of about 3 to about 5 minutes whereafter it was removed and cooled to room temperature.

A section of the composite strip was evaluated for bond strength of the lining to the backing strip and was found by test to be about 10,400 psi bond-shear strength. A microscopic inspection of the cross-section of the lining revealed an extremely fine-sized and uniform distribution of the lead particles from the surface to the steel interface as shown in Table 1 below. Total lead particles equalled at least about 1550 per square mm, and the average lead particle size was between 4 and 8 microns. Table 1 shows the lead size distribution obtained. It will be noted that the general lead size has been greatly reduced over that obtainable in conventionally sintered material as depicted, for example, in aforementioned SAE Technical Paper 86035 and that the number of lead islands at the coarse end of the histogram of Table 1 has been reduced to about 0.4%. Previously, under the best of conditions wherein conventional sintering is practiced without induction heating, a reduction of the size of the lead particles was limited to about 3.8 percent above 36 microns.

TABLE 1

Preferred Lead Size Distribution in CuPb14Sn 3.5 alloy

| Particle Size (Microns) | Percent Total Lead Particles |
|---|---|
| 0–4 | 28.2 |
| 4–8 | 31.3 |
| 8–12 | 16.7 |
| 12–16 | 10.0 |
| 16–20 | 6.4 |
| 20–24 | 3.9 |
| 24–28 | 1.6 |
| 28–32 | 0.7 |
| 32–36 | 0.8 |
| 36–40 | 0.3 |
| 40–44 | 0.1 |
| over 44 | 0 |
| Total | 100% |

It will be understood that this example is provided for illlustrative purposes and is not intended to be limiting of the scope of the present invention as herein defined and as set forth in the subjoined claims.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A copper lead tin alloy with the lead content ranging between 8 and 35 percent by weight and the tin content ranging between 0.5 and 10.0 percent by weight, and the balance essentially all copper, the microstructure of which consists of interconnected lead islands in a copper-rich matrix, the average size of the lead islands being less than 8 microns and there being not more than 1 percent of the lead islands larger than 40 microns.

2. A copper lead tin alloy as claimed in claim 1, with the lead content between 13 and 26 percent, and the tin between 0.5 and 5.0 percent.

3. A composite bearing material comprising a steel backing strip having a leaded-bronze bearing lining tenaciously bonded to at least one face thereof, said bearing lining being substantially fully dense and containing about 8 percent to about 35 percent lead, up to about 10 percent tin and the balance essentially all copper, said bearing lining furthr characterized by the lead constituted thereof being substantially uniformly distributed throughout the lining matrix in the form of fine-sized lead particles at a particle count of at least about 1550 per square millimeter, and having an average size less than about 8 microns, and wherein no more than about 0.4 percent of said lead particles are larger than 36 microns.

4. A composite bearing material as claimed in claim 3, with an interlayer of nickel bonded to said bearing lining and with an overlay of lead based alloy bonded to said interlayer, the thickness of the interlayer being 0.001–0.005 mm, and the thickness of the overlayer being 0.01–0.05 mm.

5. A composite bearing material as claimed in claim 4 with the lead content between 13 and 26 percent, and the tin between 0.5 and 5.0 percent.

6. A process for producing steel backed strip with a lining of copper-lead-tin alloy in which copper-lead-tin alloy powder is spread onto steel strip, the temperature of the strip is raised in an induction coil to a temperature in excess of 700° C., the temperature being subsequently raised by other means to approximately 800°–850° C. to sinter the powder particles to one another and to the steel, the total time spent by the strip between 650° and 850° C. being less than two minutes, the whole heating operation being carried out in a reducing atmosphere, and the sintered layer being subsequently roll compacted and re-sintered.

* * * * *